US011510501B2

(12) United States Patent
Huang

(10) Patent No.: US 11,510,501 B2
(45) Date of Patent: Nov. 29, 2022

(54) POSITION ADJUSTMENT MECHANISM FOR LIFTING BALANCE DEVICE

(71) Applicant: Hsien-Ta Huang, Taoyuan (TW)

(72) Inventor: Hsien-Ta Huang, Taoyuan (TW)

( * ) Notice: Subject to any disclaimer, the term of this patent is extended or adjusted under 35 U.S.C. 154(b) by 486 days.

(21) Appl. No.: 16/689,042

(22) Filed: Nov. 19, 2019

(65) Prior Publication Data

US 2020/0178696 A1 Jun. 11, 2020

(30) Foreign Application Priority Data

Dec. 5, 2018 (TW) ..... 107143883

(51) Int. Cl.
*A47C 20/04* (2006.01)
*A47G 9/10* (2006.01)

(52) U.S. Cl.
CPC ..... *A47C 20/042* (2013.01); *A47G 9/10* (2013.01)

(58) Field of Classification Search
CPC ..... A47C 20/042; A47C 20/04; A47C 19/04; A47C 20/043; A47C 19/14; A47G 9/10; A47G 9/1009; A61G 7/07; A61G 7/072; B66F 7/14; B66F 17/006; B66F 7/0608; B25B 15/007; B25B 15/02; B25G 1/105
See application file for complete search history.

(56) References Cited

U.S. PATENT DOCUMENTS 4,405,116 A * 9/1983 Eisenberg ..... B66F 7/0608 187/269
4,449,262 A * 5/1984 Jahsman ..... A61G 13/06 5/616
4,467,677 A * 8/1984 Grifford ..... B25F 1/00 81/439
7,093,691 B1 * 8/2006 Vaughan ..... B66B 9/0815 187/244
7,243,578 B2 * 7/2007 Burwell ..... B25B 13/56 81/177.5
2001/0034909 A1 * 11/2001 Babbini ..... A47G 9/10 5/725
2004/0172762 A1 * 9/2004 Lenyo ..... A47G 9/10 5/640

(Continued)

FOREIGN PATENT DOCUMENTS

CN 203146734 U * 8/2013
KR 20120117589 A * 10/2021

*Primary Examiner* — Peter M. Cuomo
*Assistant Examiner* — Alison N Labarge
(74) *Attorney, Agent, or Firm* — Chun-Ming Shih; Lanway IPR Services

(57) ABSTRACT

A position adjustment mechanism for a lifting balance device contains: a first cover and an adjustment device. The first cover includes at least one lifting balance device, and each of the at least one lifting balance device includes a first support, a second support intersected with the first support, and a shaft configured to connected the first and second supports. The adjustment device is located bellow the shaft. The adjustment device is fixed inside the first cover, the first cover has a first opening located below the shaft. A threaded sleeve is connected with the first opening and is screwed with a threaded tube, such that the threaded tube is adjustably moved relative to the threaded sleeve so as to change a position of a top of the threaded tube and to limit a lowest descending position of each of the first support and the second support.

9 Claims, 5 Drawing Sheets

(56) References Cited

U.S. PATENT DOCUMENTS

| | | | | |
|---|---|---|---|---|
| 2006/0087166 | A1* | 4/2006 | Trippensee | B66F 7/0608 297/338 |
| 2006/0180403 | A1* | 8/2006 | Hanlon | B66F 7/0666 187/269 |
| 2007/0266809 | A1* | 11/2007 | Ziesel | F16H 25/2252 74/127 |
| 2008/0168852 | A1* | 7/2008 | Chen | F16H 25/2472 74/89.23 |

* cited by examiner

POSITION ADJUSTMENT MECHANISM FOR LIFTING BALANCE DEVICE

FIELD OF THE INVENTION

The present invention relates to a position adjustment mechanism which is fixed below a lifting balance device of a pillow so as to adjust the pillow to a lowest descending height based on using requirements.

BACKGROUND OF THE INVENTION

It is essential for people to adjust a height of a pillow when sleeping on their backs or on their sides. However, the pillow cannot be adjusted to a desired height.

A conventional adjustable pillow has been developed, but it can only be adjustably lifted to a fixed height. In other words, the conventional adjustable pillow cannot be adjusted to a lowest descending height based on using requirements.

The present invention has arisen to mitigate and/or obviate the afore-described disadvantages.

SUMMARY OF THE INVENTION

The primary aspect of the present invention is to provide a position adjustment mechanism which is fixed below a lifting balance device of a pillow so as to adjust the pillow to a lowest descending height based on using requirements.

To obtain above-mentioned aspect, a position adjustment mechanism provided by the present invention contains: a first cover and an adjustment device.

The first cover includes at least one lifting balance device arranged therein, and each of the at least one lifting balance device includes a first support, a second support intersected with the first support, and a shaft configured to connected the first support and the second support.

The adjustment device is located bellow the shaft.

The adjustment device is fixed inside the first cover, the first cover has a first opening defined thereon and located below the shaft, a threaded sleeve is connected with the first opening and is screwed with a threaded tube, such that the threaded tube is adjustably moved relative to the threaded sleeve so as to change a position of a top of the threaded tube and to limit a lowest descending position of each of the first support and the second support.

Preferably, a shoulder is formed around an inner rim of the first opening and is configured to stop a removal of the threaded sleeve.

Preferably, the threaded sleeve is polygonal, and the adjustment device includes a positioning sheet located above the threaded sleeve and formed in a C shape, wherein the fixing sheet has a second opening defined in a center thereof, two extensions extending from two sides of an upper end of the adjustment device respectively, and multiple screw bolts configured to screw the two extensions with multiple locking elements of the first cover respectively.

Preferably, the threaded tube has a through hole defined therein so as to connect with a first connector and a second connector by mating with a screwing element.

Preferably, the first connector has a first tab surrounding around a top thereof, a first connection column extending from a center of a bottom thereof, and a notch defined in the first connection column and formed in a polygon shape; the second connector has a second tab surrounding around a bottom thereof, a second connection column extending from a center of a top thereof, and a peg extending from the second connection column and formed in a polygon shape so as to rotatably connect with the notch.

Preferably, the first cover has a peripheral surround portion extending from a peripheral side of the first opening.

Preferably, the second connection column has a recess for accommodating an adjusting element.

Preferably, the recess is in any one of a "1" shape, a cross shape, a double intersected cross shape, and a polygon shape.

Preferably, the adjusting element includes a first fixing portion defined on a center of a first end of the adjusting element, wherein the first fixing portion has two first stop portions arranged on two sides thereof respectively, wherein a width of the first fixing portion is equal to that of the second connection column, and the width of the first fixing portion is more than a diameter of the first opening of the first cover.

Preferably, the adjusting element is formed in a cross shape and further includes a first fixing portion defined on a center of a first end of the adjusting element, wherein the first fixing portion has two first stop portions arranged on two sides thereof respectively; the adjusting element includes a second fixing portion defined on a center of a side of the adjusting element, wherein the second fixing portion has two second stop portions arranged on two sides thereof respectively, and the adjusting element further includes a third fixing portion formed on a center of a second end thereof, wherein the third fixing portion has two third stop portions arranged on two sides thereof respectively; wherein a height of the first fixing portion is different from a height of the second fixing portion, the height of the second fixing portion is different from a height of the third fixing portion, and the height of the third fixing portion is different from that of the first fixing portion.

DETAILED DESCRIPTION OF THE PREFERRED EMBODIMENTS

Figure 1:
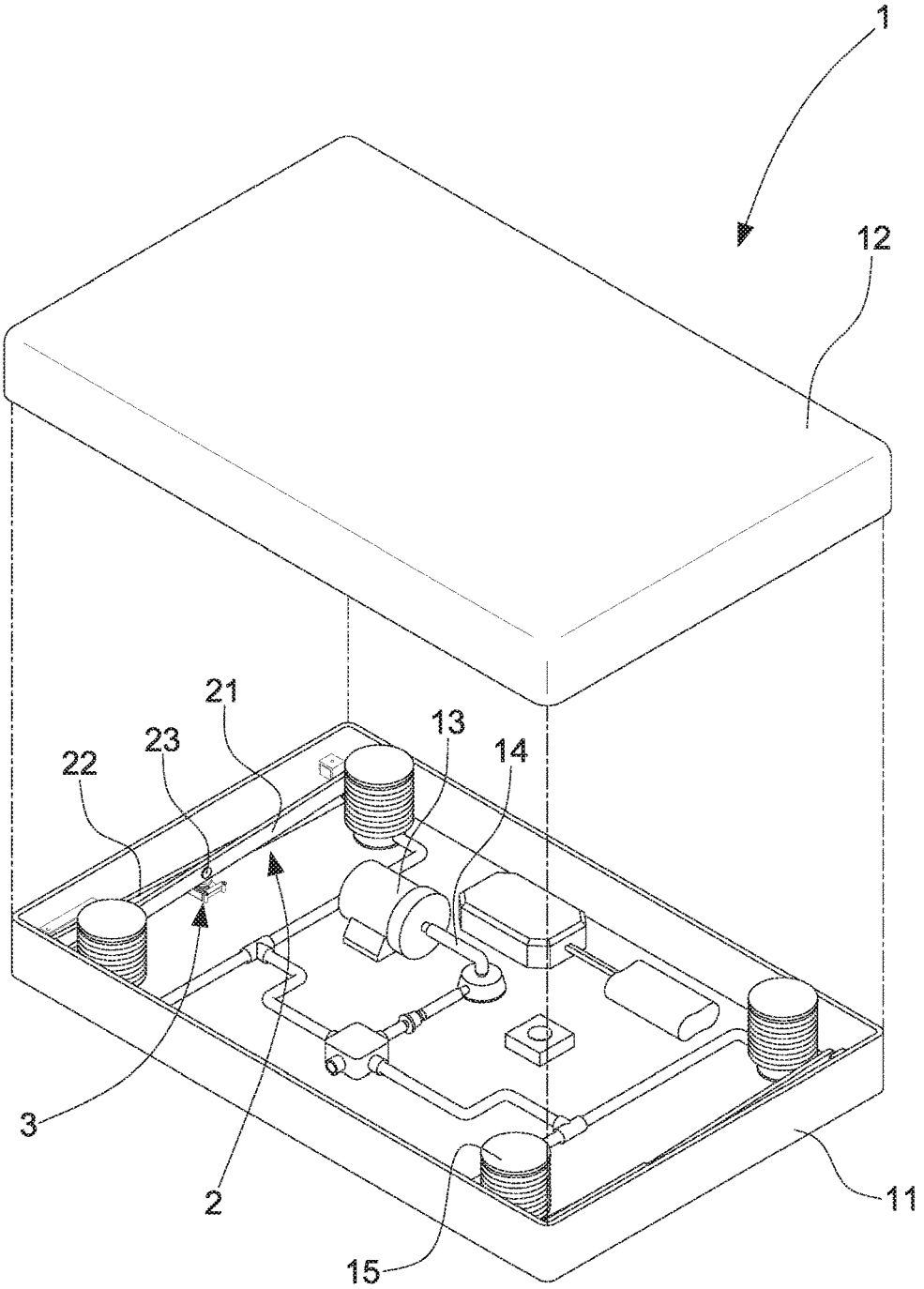
FIG. 1 is a perspective view showing the application of a position adjustment mechanism for a lifting balance device according to a preferred embodiment of the present invention.
Figure 2:
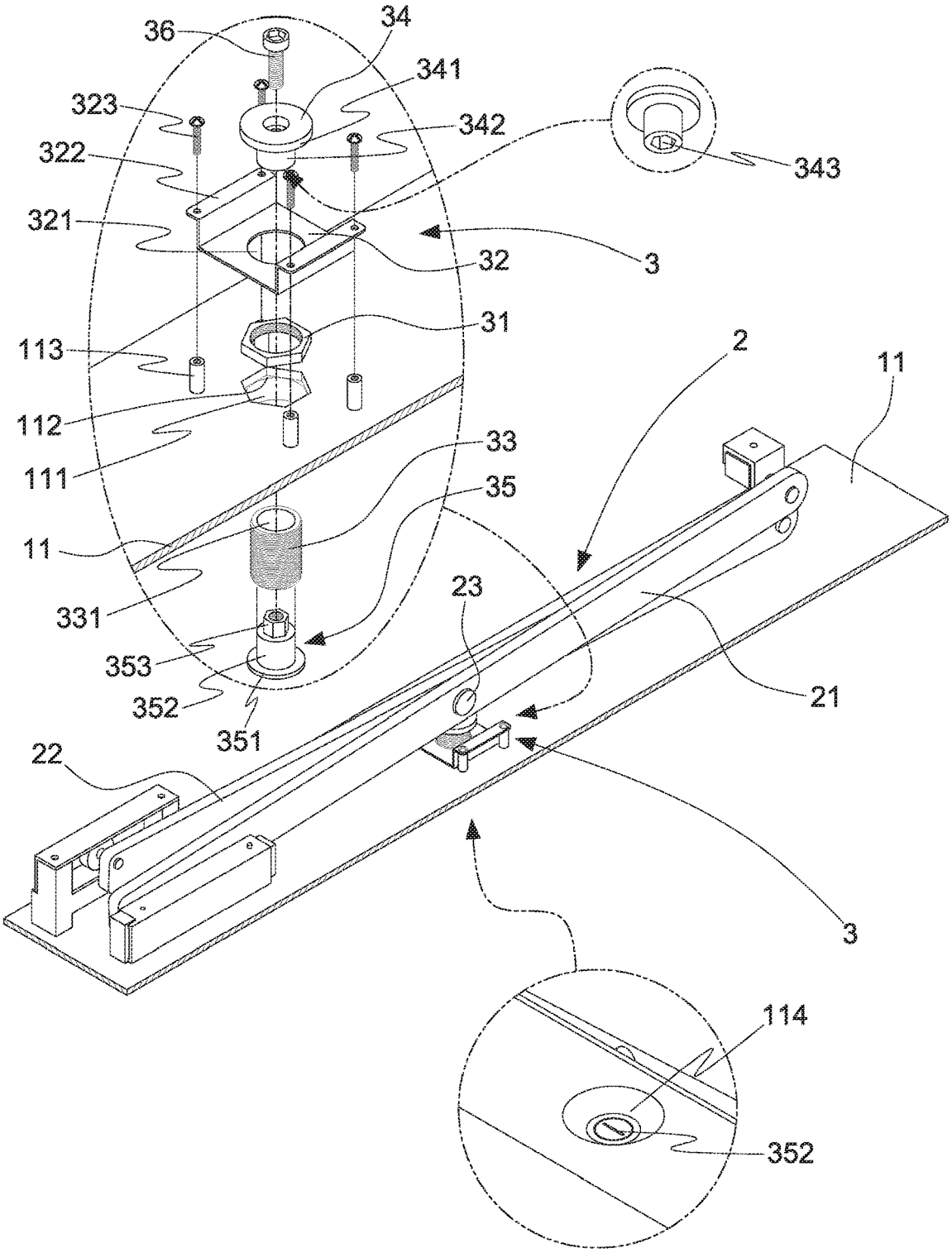
FIG. 2 is a perspective view showing the exploded components of the position adjustment mechanism for the lifting balance device according to the preferred embodiment of the present invention.
Figure 3:
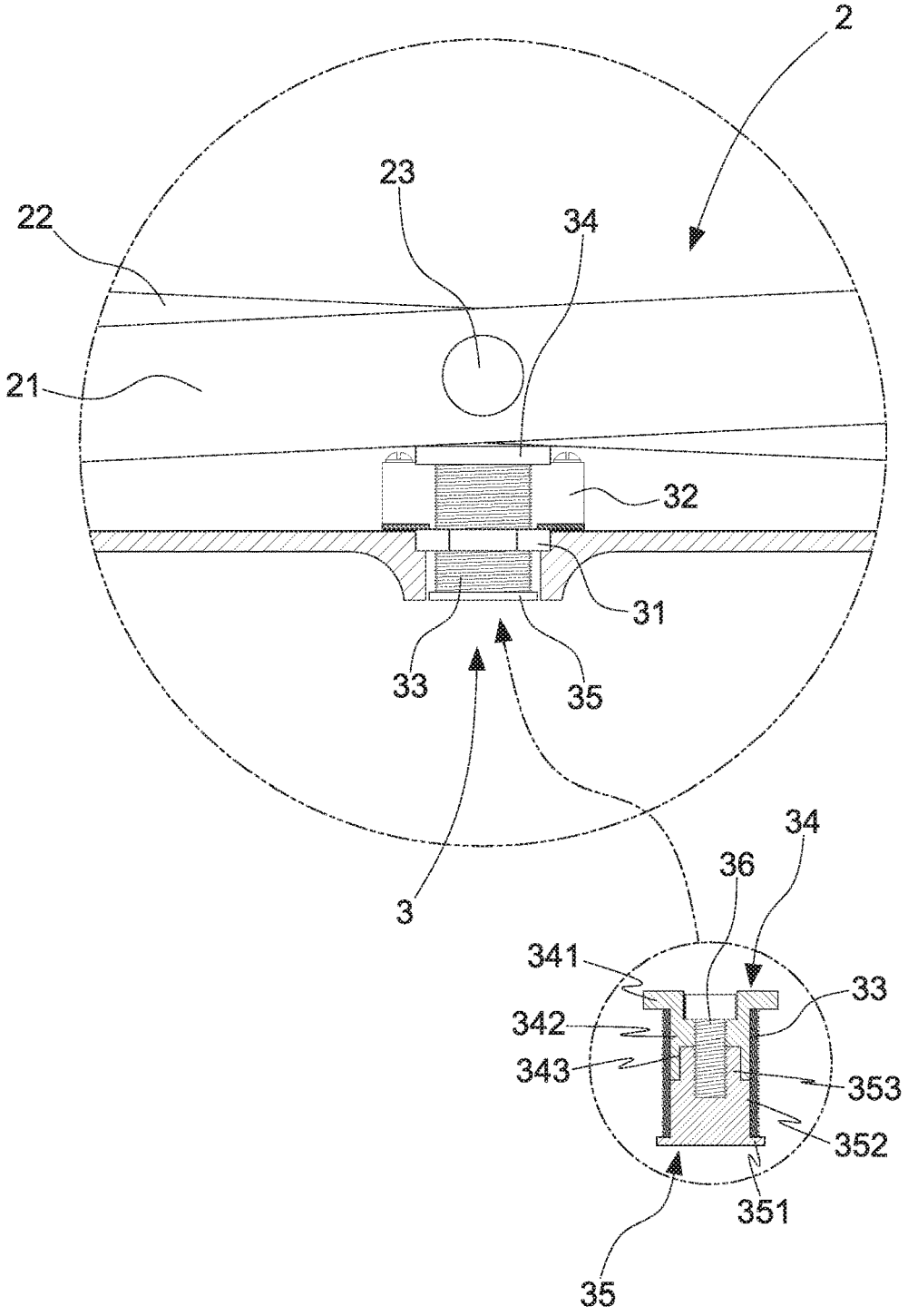
FIG. 3 is a cross sectional view showing the assembly of a part of the position adjustment mechanism for the lifting balance device according to the preferred embodiment of the present invention.

With reference to FIGS. 1-3, a position adjustment mechanism for a lifting balance device according to a preferred embodiment of the present invention comprises: an adjustable pillow 1 including a first cover 11, a second cover 12, an air pump 13 defined between the first cover 11 and the second cover 12, multiple air pipes 14, multiple capsules 15, and two lifting balance devices 2.

Each of the two lifting balance devices 2 includes a first support 21, a second support 22 intersected with the first support 21, and a shaft 23 configured to connected the first support 21 and the second support 23.

An adjustment device 3 is located bellow the shaft 23 and is movably adjusted to a highest lifting position so as to limit a lowest descending position of each of the first support 21 and the second support 22.

The adjustment device 3 is fixed inside the first cover 11, wherein the first cover 11 has a first opening 11 defined thereon and located below the shaft 23, a shoulder 112 formed around an inner rim of the first opening 111, and multiple locking elements 113 mounted around the first opening 111.

The adjustment device 3 includes a threaded sleeve 31 which is polygonal and is connected with the first opening 111 of the first cover 11 securely, and the shoulder 112 of the first opening 111 stops a removal of the threaded sleeve 31. The adjustment device 3 includes a positioning sheet 32 located above the threaded sleeve 31 and formed in a C shape, wherein the fixing sheet 32 has a second opening 321 defined in a center thereof, two extensions 322 extending from two sides of an upper end of the adjustment device 3 respectively, and multiple screw bolts 323 configured to screw the two extensions 322 with the multiple locking elements 113 of the first cover 11 respectively. The threaded sleeve 31 is screwed with and is rotated relative to a threaded tube 33, the threaded tube 33 has a through hole 331 defined in a center thereof so as to connect with a first connector 34 and a second connector 35 by mating with a screwing element 36. The first connector 34 has a first tab 341 surrounding around a top thereof, a first connection column 342 extending from a center of a bottom thereof, and a notch 343 defined in the first connection column 342 and formed in a polygon shape. The second connector 35 has a second tab 351 surrounding around a bottom thereof, a second connection column 352 extending from a center of a top thereof, and a peg 353 extending from the second connection column 352 and formed in a polygon shape so as to rotatably connect with the notch 343. Thereby, when the second connector 35 is rotated, it is rotatably connected with the second connector 34 so as to drive the threaded tube 33 to rotatably move upward and downward.

The first cover 11 has a peripheral surround portion 114 extending from a peripheral side of the first opening 111 so as to enhance reinforcement of the first cover 11 and to accommodate the adjustment device 3.

Figure 4:
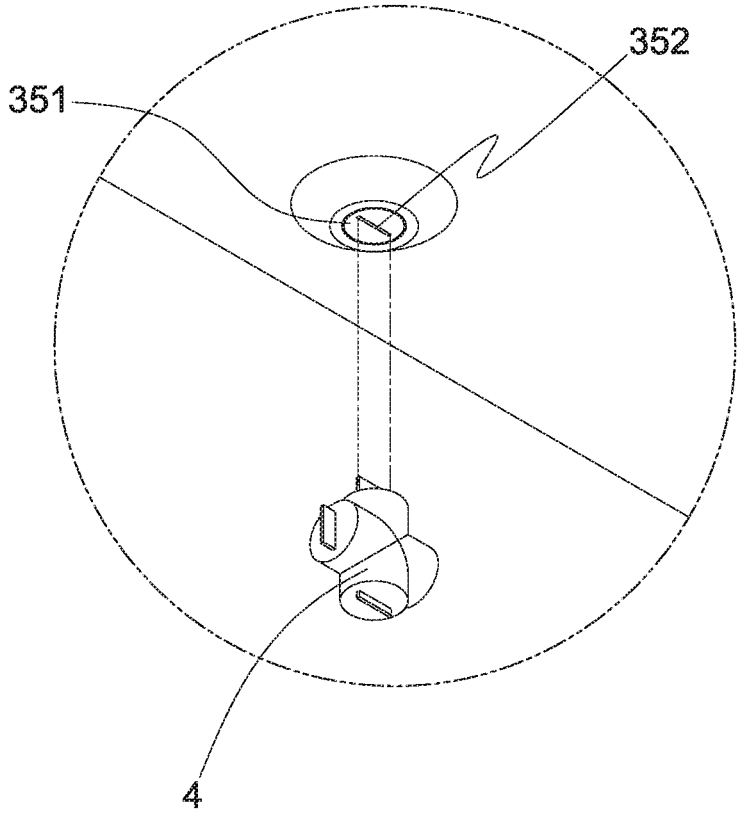
FIG. 4 is a perspective view showing the operation of a part of the position adjustment mechanism for the lifting balance device according to the preferred embodiment of the present invention.

The second connector 35 has the second connection column 352 having a recess in any one of a "1" shape, a cross shape, a double intersected cross shape, and a polygon shape so as to connect with an adjustment element 4 (as shown in FIG. 4).

Figure 5:
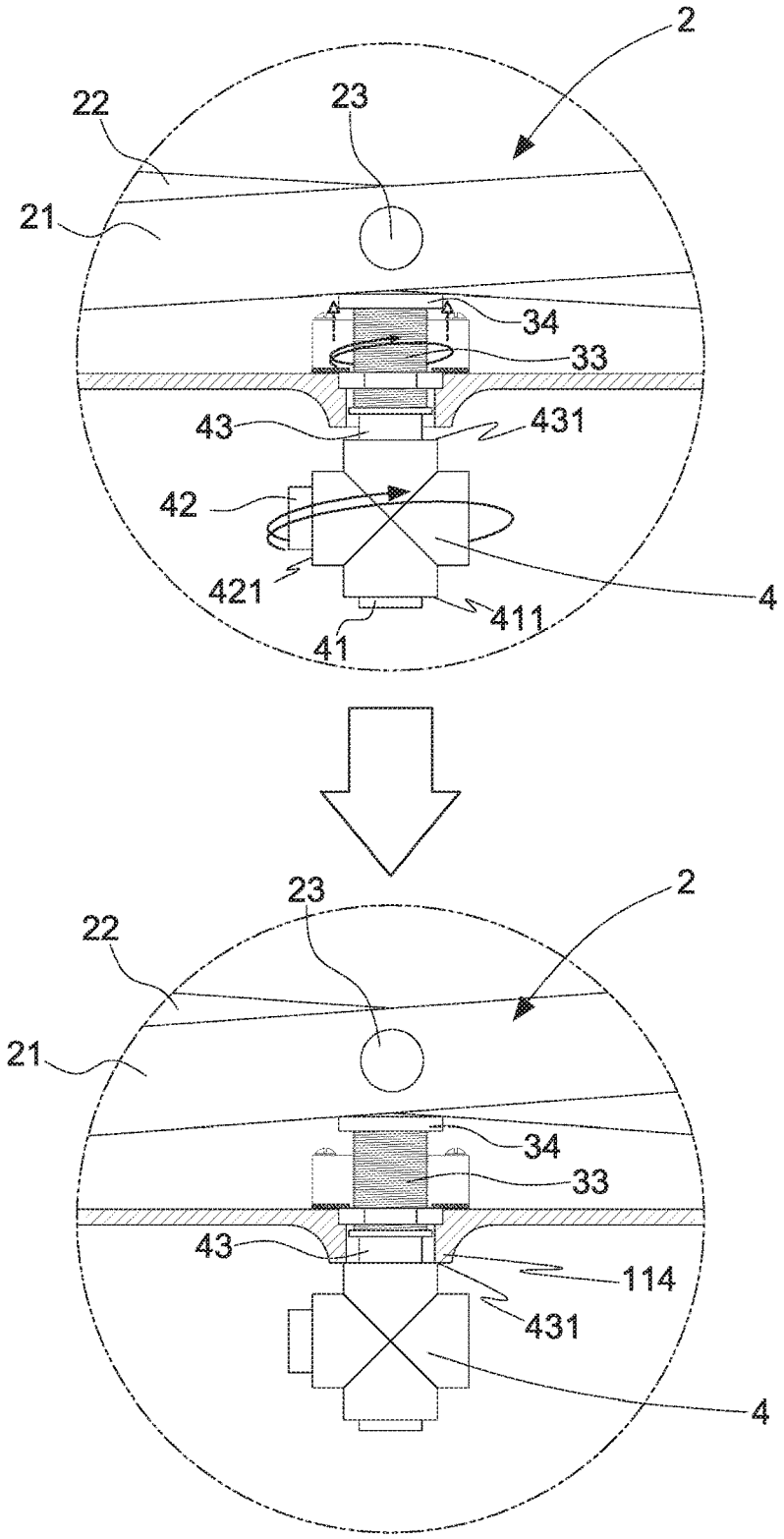
FIG. 5 is a cross sectional view showing the operation of a part of the position adjustment mechanism for the lifting balance device according to the preferred embodiment of the present invention.

The adjusting element 4 is formed in a cross shape, wherein the adjusting element 4 includes a first fixing portion 41 defined on a center of a first end of the adjusting element 4 (as illustrated in FIG. 5), wherein the first fixing portion 41 has two first stop portions 411 arranged on two sides thereof respectively, wherein a width of the first fixing portion 41 is equal to that of the second connection column 352, and the width of the first fixing portion 41 is more than a diameter of the first opening 111 of the first cover 11 so the first fixing portion 41 does not move into the first opening 111.

The adjusting element 4 further includes a second fixing portion 42 defined on a center of a side of the adjusting element 4, wherein the second fixing portion 42 has two second stop portions 421 arranged on two sides thereof respectively, and the adjusting element 4 further includes a third fixing portion 43 formed on a center of a second end thereof, wherein the third fixing portion 43 has two third stop portions 431 arranged on two sides thereof respectively.

A height of the first fixing portion 41 is different from a height of the second fixing portion 42, the height of the second fixing portion 42 is different from a height of the third fixing portion 43, and the height of the third fixing portion 43 is different from that of the first fixing portion 41, wherein a length of the first fixing portion 41 is less than a length of the second fixing portion 42, and the length of the second fixing portion 42 is less than a length of the third fixing portion 43. The first fixing portion 41, the second fixing portion 42, the third fixing portion 43 are inserted into and rotated in the second connection column 352 so as to rotatably move the second connector 35, the threaded tube 33, and the first connector 34 upward and downward until the two first stop portions 411, the two second stop portions 421, the two third stop portions 431 contact with the peripheral surround portion 114 of the first cover 11.

When lifting each lifting balance device 2, the adjustment device 3 does not move. Referring to FIGS. 4 and 5, when descending each lifting balance device 2, the third fixing portion 43 is inserted into the second connection column 352, and the adjusting element 4 is rotated to drive the second connector 35 and the threaded tube 33 to move upward relative to the threaded sleeve 31 until the two third stop portions 431 contact with the peripheral surround portion 114 of the first cover 11. In the meantime, the first connector 34 moves upward to a desired height. When descending each lifting balance device 2, bottoms of the first support 21 and the second support 22 contact with the first connector 34 so as to limit the lowest descending position of each of the first support 21 and the second support 22, wherein the lowest descent portion of each of the first and second supports 22 is a sleeping height of the pillow 1.

When a lowest descending position of the third fixing portion 43 inserted into and rotated in the second connection column 352 does not match with the desired height, the first fixing portion 41 or the second fixing portion 42 is inserted into the second connection column 352 to adjust the lowest descending position of the first fixing portion 41 or the second fixing portion 42 toward the desired height.

In another embodiment, the adjusting element 4 includes more than three fixing portions configured to insert into the second connection column based on using requirements.

Accordingly, the position adjustment mechanism is mounted below the lifting balance device so as to adjust the pillow toward the lowest descending position. Preferably, the adjustment device is capable of adjusting two sides of the pillow consistently.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A position adjustment mechanism for a lifting balance device comprising:

a first cover in which at least one lifting balance device is arranged, and each of the at least one lifting balance device including a first support, a second support intersected with the first support, and a shaft configured to connect the first support and the second support; and an adjustment device located below the shaft;

wherein the adjustment device is fixed inside the first cover, the first cover has a first opening defined thereon and located below the shaft, a threaded sleeve is connected with the first opening and is screwed with a threaded tube, such that the threaded tube is adjustably moved relative to the threaded sleeve so as to change a position of a top of the threaded tube and to limit a lowest descending position of each of the first support and the second support, wherein the threaded sleeve is polygonal, and the adjustment device includes a positioning sheet located above the threaded sleeve and formed in a C shape, wherein the positioning sheet has a second opening defined in a center thereof, two extensions extending from two sides of an upper end of the adjustment device respectively, and multiple screw bolts configured to screw the two extensions with multiple locking elements of the first cover respectively.

2. The position adjustment mechanism as claimed in claim 1, wherein a shoulder is formed around an inner rim of the first opening and is configured to stop a removal of the threaded sleeve.

3. The position adjustment mechanism as claimed in claim 1, wherein the first cover has a peripheral surround portion extending from a peripheral side of the first opening.

4. A position adjustment mechanism for a lifting balance device comprising:

a first cover in which at least one lifting balance device is arranged, and each of the at least one lifting balance device including a first support, a second support intersected with the first support, and a shaft configured to connect the first support and the second support; and an adjustment device located below the shaft;

wherein the adjustment device is fixed inside the first cover, the first cover has a first opening defined thereon and located below the shaft, a threaded sleeve is connected with the first opening and is screwed with a threaded tube, such that the threaded tube is adjustably moved relative to the threaded sleeve so as to change a position of a top of the threaded tube and to limit a lowest descending position of each of the first support and the second support;

wherein the threaded tube has a through hole defined therein so as to connect with a first connector and a second connector by mating with a screwing element.

5. The position adjustment mechanism as claimed in claim 4, wherein the first connector has a first tab surrounding around a top thereof, a first connection column extending from a center of a bottom thereof, and a notch defined in the first connection column and formed in a polygon shape; the second connector has a second tab surrounding around a bottom thereof, a second connection column extending from a center of a top thereof, and a peg extending from the second connection column and formed in a polygon shape so as to rotatably connect with the notch.

6. The position adjustment mechanism as claimed in claim 5, wherein the second connection column has a recess for accommodating an adjusting element.

7. The position adjustment mechanism as claimed in claim 6, wherein the recess is in any one of a "1" shape, a cross shape, a double intersected cross shape, and a polygon shape.

8. The position adjustment mechanism as claimed in claim 6, wherein the adjusting element includes a first fixing portion defined on a center of a first end of the adjusting element, wherein the first fixing portion has two first stop portions arranged on two sides thereof respectively, wherein a width of the first fixing portion is equal to that of the second connection column, and the width of the first fixing portion is more than a diameter of the first opening of the first cover.

9. The position adjustment mechanism as claimed in claim 6, wherein the adjusting element is formed in a cross shape and further includes a first fixing portion defined on a center of a first end of the adjusting element, wherein the first fixing portion has two first stop portions arranged on two sides thereof respectively; the adjusting element includes a second fixing portion defined on a center of a side of the adjusting element, wherein the second fixing portion has two second stop portions arranged on two sides thereof respectively, and the adjusting element further includes a third fixing portion formed on a center of a second end thereof, wherein the third fixing portion has two third stop portions arranged on two sides thereof respectively; wherein a height of the first fixing portion is different from a height of the second fixing portion, the height of the second fixing portion is different from a height of the third fixing portion, and the height of the third fixing portion is different from that of the first fixing portion.

* * * * *